US005718176A

United States Patent [19]

Stephan

[11] Patent Number: 5,718,176

[45] Date of Patent: Feb. 17, 1998

[54] METHOD AND DEVICE FOR PNEUMATICALLY BRAKING SHEETS IN A DELIVERY OF A SHEET-FED ROTARY PRINTING PRESS

[75] Inventor: Günter Stephan, Wiesloch-Baiertal, Germany

[73] Assignee: Heidelberger Druckmaschinen AG, Heidelberg, Germany

[21] Appl. No.: 681,940

[22] Filed: Jul. 29, 1996

[30] Foreign Application Priority Data

Jul. 27, 1995 [DE] Germany ..... 195 27 441.5

[51] Int. Cl.[6] ..... B65H 29/68; B65H 29/24

[52] U.S. Cl. ..... 101/483; 101/232; 271/182; 271/195; 406/84; 406/88

[58] Field of Search ..... 101/232, 483; 271/182, 183, 195, 204; 406/84, 86, 88

[56] References Cited

U.S. PATENT DOCUMENTS

| | | | |
|---|---|---|---|
| 3,081,082 | 3/1963 | Spooner et al. | 271/183 |
| 3,437,335 | 4/1969 | Gluskin | 271/195 |
| 3,503,607 | 3/1970 | Gluskin | 271/195 |
| 4,479,645 | 10/1984 | Pollich | 271/183 |
| 4,993,882 | 2/1991 | Nishizuka et al. | 406/84 |

FOREIGN PATENT DOCUMENTS

| | | | |
|---|---|---|---|
| 2720674 | 9/1978 | German Dem. Rep. | 271/182 |
| 3713344 | 11/1988 | German Dem. Rep. | 271/204 |
| 2020430 | 12/1971 | Germany | 271/195 |
| 2 135 105 | 11/1972 | Germany . | |
| 23 58 206 | 5/1975 | Germany . | |
| 27 20 674 | 11/1978 | Germany . | |
| 52-69186 | 8/1977 | Japan | 406/84 |

*Primary Examiner*—Edgar S. Burr
*Assistant Examiner*—Amanda B. Sandusky
*Attorney, Agent, or Firm*—Herbert L. Lerner; Laurence A. Greenberg

[57] ABSTRACT

Method for pneumatically braking sheets in a delivery of a sheet-fed rotary printing press by means of blast air directed opposite to a sheet-transport direction for forming an air flow for braking the sheet includes adjusting the air flow for braking the sheet to a state of equilibrium between energy of the air flow acting upon the sheet and kinetic energy of the sheet, the sheet being carried in the region of a braking path in a contact-free manner by the air flow, and device for performing the method.

6 Claims, 3 Drawing Sheets

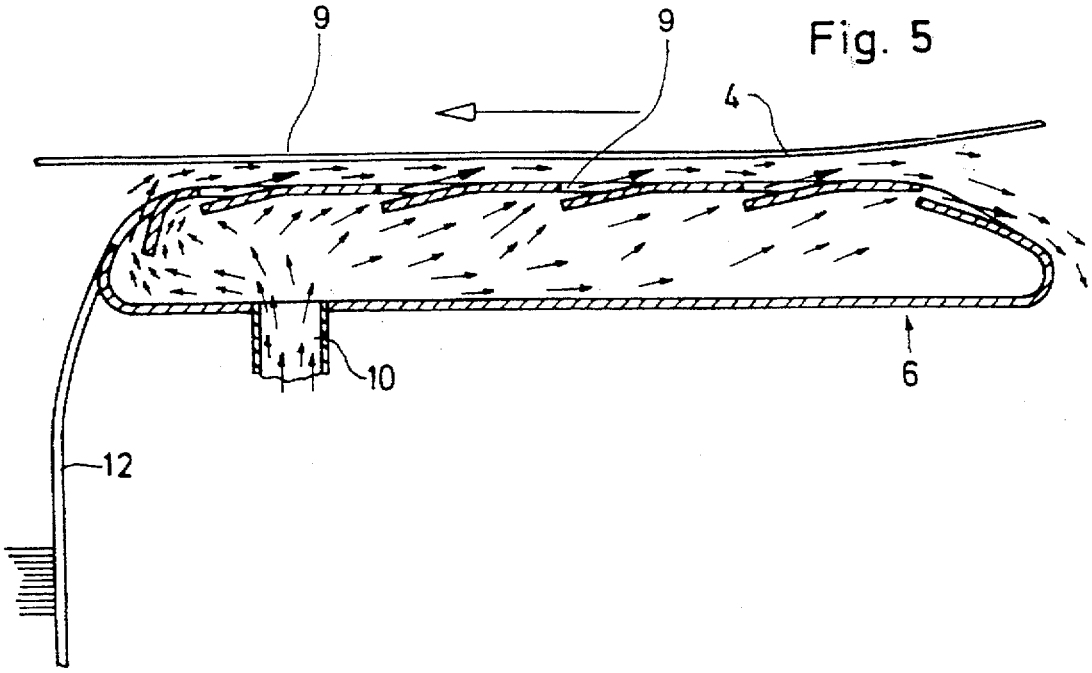
Fig. 5
Fig. 6
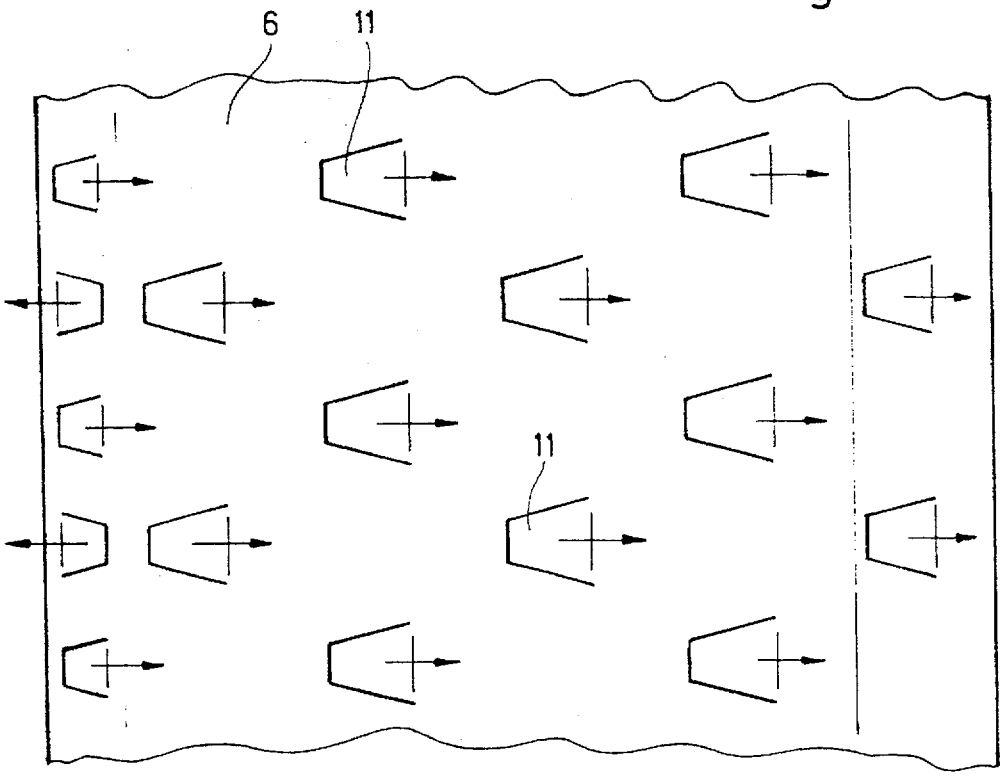

METHOD AND DEVICE FOR PNEUMATICALLY BRAKING SHEETS IN A DELIVERY OF A SHEET-FED ROTARY PRINTING PRESS

BACKGROUND OF THE INVENTION

Field of the Invention

The invention relates to a method and a device for pneumatically braking sheets in a delivery of a sheet-fed rotary printing press and, more particularly, by means of blast air directed opposite to a sheet-transport direction.

The closest prior art to the method according to the invention and to the device according to the invention for performing the method is disclosed in the published German Patent Document DE-AS 21 35 105, wherefrom it is known to apply blast air underneath an oncoming sheet over the entire width or breadth thereof, the sheet being held at a leading edge thereof, as viewed in the sheet-transport direction, by sheet grippers of a gripper system revolving on conveying chains, the blast air being discharged from air-blast nozzles of an air-blast nozzle bar and being directed opposite to the sheet-transport direction, the air-blast nozzle bar being disposed beneath the travel path of the sheet in a conveyor or transport section of the sheet directly before a leading edge of a delivery pile. This air flow directed opposite to the direction of sheet travel or motion produces, at the trailing edge of the air-blast nozzle bar, as viewed in the sheet-transport or travel direction, a negative pressure or vacuum by which the sheet is suction-gripped and, consequently, as a result of the frictional forces created, is braked by friction. In this regard, the sheet comes into frictional contact, over the entire width or breadth thereof, completely or in individual zones, with the air-blast nozzle bar, so that, particularly in first-form-and-perfector or recto-and-verso printing mode, it is easily possible for smudging or smearing to occur. The air-blast nozzle bar is adjoined, opposite to the sheet-transport direction, by a backwardly bent, horn-shaped guide plate with exposed lugs. The blast air emitted by the air-blast nozzles of the air-blast nozzle bar is directed beneath the sheet, flows over the curved surface and causes the sheet, by negative pressure or vacuum, to hug the guide lugs.

Devices having an identical effect, yet being of different construction, have become known heretofore from the German Patent 23 58 206 and from the published German Patent Document DE-OS 27 20 674.

SUMMARY OF THE INVENTION

It is accordingly an object of the invention to provide a method and a device for pneumatically braking sheets in a delivery of a sheet-fed rotary printing press which offers a solution for a contact-free braking of a sheet carried by an air flow on a braking path in a delivery of a sheet-fed rotary printing press for high-quality printed products, which prevents smudging or smearing, particularly in recto-and-verso printing mode, when the sheet is braked.

With the foregoing and other objects in view, there is provided, in accordance with one aspect of the invention, a method for pneumatically braking sheets in a delivery of a sheet-fed rotary printing press by means of blast air directed opposite to a sheet-transport direction for forming an air flow for braking the sheet, which comprises adjusting the air flow for braking the sheet to a state of equilibrium between energy of the air flow acting upon the sheet and kinetic energy of the sheet, the sheet being carried in the region of a braking path in a contact-free manner by the air flow.

In accordance with another mode of the method according to the invention, wherein the blast air also forms an air flow directed opposite to the air flow for carrying the sheet in a contact-free manner on the braking path thereof, the sheet being transported by the oppositely directed air flow in a contact-free manner to a delivery pile, the method includes downwardly diverting both of the air flows in a controlled manner upstream of the braking section of the sheet, as viewed in the sheet-transport direction.

In accordance with a further mode of the method according to the invention, wherein the blast air is emitted from braking nozzles, the method includes returning the downwardly diverted air flows to the braking nozzles through the intermediary of a control element.

In accordance with a further aspect of the invention, there is provided a device for pneumatically braking sheets in a delivery of a sheet-fed rotary printing press by means of blast air directed opposite to a sheet-transport direction for forming an air flow for braking the sheet, comprising an air-blast nozzle bar having air-blast nozzles directed opposite to the sheet-transport direction, the air-blast nozzle bar being formed, at least at a trailing end thereof, as viewed in the sheet-transport direction, with a rounded-off cross-sectional profile and having, at an upper side thereof, blast-air nozzles in the region of the rounded-off end thereof.

In accordance with an added aspect of the invention, there is provided a device for pneumatically braking sheets in a delivery of a sheet-fed rotary printing press by means of blast air directed opposite to a sheet-transport direction for forming an air flow for braking the sheet, comprising a blast-air device for floatingly transporting the sheet on an air flow in a contact-free manner to a delivery pile, a blast-air device for forming the air flow for braking the sheet, the air flows being directed against one another beneath the sheet, and a duct disposed between the blast-air devices for diverting both of the air flows.

In accordance with an added feature of the invention, the air-blast nozzles in the air-blast nozzle bar are adjustable in discharge direction.

In accordance with an additional feature of the invention, the air-blast nozzles of the air-blast nozzle bar are air-blast nozzles which are directed opposite to the sheet-transport direction and air-blast nozzles directed for discharging blast air in the sheet-transport direction.

In accordance with a concomitant aspect of the invention, there is provided a device for pneumatically braking sheets in a delivery of a sheet-fed rotary printing press by means of blast air directed opposite to a sheet-transport direction for forming an air flow for braking the sheets, comprising a flotation-guiding arrangement preceding a braking section, as viewed in the sheet-transport direction, for aiding in contact-free guidance of the sheets in the braking section, so that a contact-free overlapping shingling of the sheets occurs and time is saved for braking the sheets.

Deviating from the previously attempted solutions according to the prior art, the effect of the method according to the invention is based not on friction of the sheet to be braked, but rather on shear stresses in the air flow carrying the sheet in a contactless or contact-free manner. The braking force results from the product of the shear stress produced at the interface in the air flow and the area to which the air flow is applied. In order to attain this effect, the air flow is formed between a guide plate and the sheet, the inlet pressure of the air flow being converted into kinetic energy and the air flow being uniformly propagated to form an area-covering film flow beneath the sheet.

The method according to the invention is particularly applicable for the more or less contactless or contact-free transport of the sheet in the delivery on an air flow carrying the sheet, the air flow being directed in the sheet-transport direction. In such a case, both the air flow carrying the sheet and directed in the sheet-transport direction, and also the air flow directed opposite to the sheet-transport direction for braking the sheet are downwardly diverted in a controlled manner before, i.e., upstream from, the actual sheet-braking section. The downwardly diverted air flow may, where appropriate, be returned through the intermediary of control devices to the air-blast nozzles of one or the other of the air flows.

As noted hereinbefore, a device is provided for performing the method according to the invention wherein an air-blast nozzle bar having air-blast nozzles directed opposite to the sheet-transport direction, is formed with, at least at a trailing end thereof, with a rounded-off cross-sectional profile and blast-air nozzles in the region of the rounded-off end. These structural features prevent the formation of a vacuum or negative pressure beneath the sheet, and thus prevent vacuum-gripping of the sheet.

Disposed between the air-blast device floatingly transporting the sheet as far as the braking section, and an air-blast device for braking the sheet through oppositely directed blast air is a duct for diverting the mutually opposed air flows.

In order to regulate the air flow for sheet braking, the air flow and the air pressure are adjustable. Further possibilities of regulation are provided by adjustable air-blast nozzles with controllable throttles and directionally adjustable nozzle openings.

Other features which are considered as characteristic for the invention are set forth in the appended claims.

Although the invention is illustrated and described herein as embodied in a method and a device for pneumatically braking sheets in a delivery of a sheet-fed rotary printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

BRIEF DESCRIPTION OF THE DRAWING

FIG. 5 is a vertical cross-sectional view of an air-blast nozzle bar of the pneumatic sheet-braking device;

FIG. 6 is a fragmentary top plan view of the air-blast nozzle bar of FIG. 5;

DESCRIPTION OF THE PREFERRED EMBODIMENTS

Figure 1:
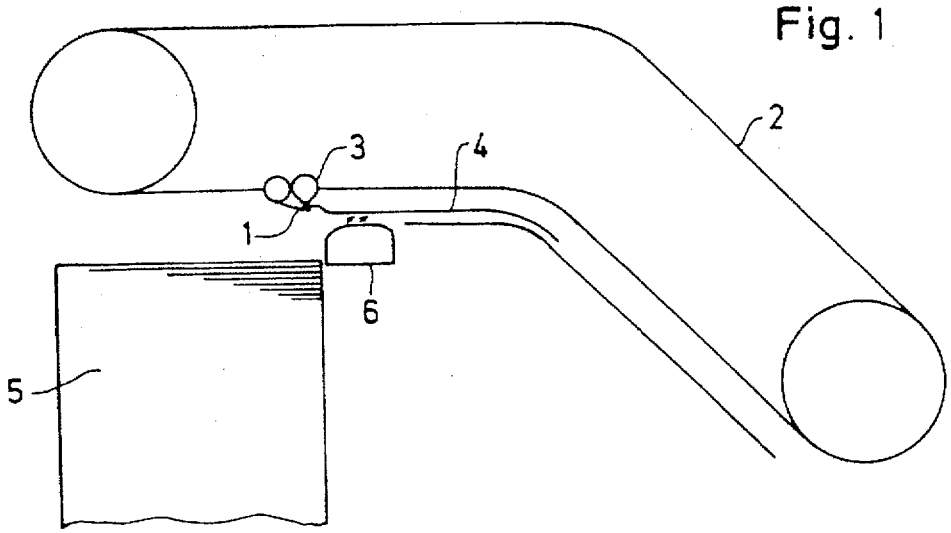
FIG. 1 is a diagrammatic side elevational view of a sheet delivery with a delivery pile and including an embodiment of the pneumatic sheet-braking device according to the invention.

Referring now to the drawings and, first, particularly to FIG. 1 thereof, there is shown therein a sheet delivery, wherein sheet grippers 1 of a gripper system 3 disposed on revolvingly guided conveying chains 2 grip the sheet 4 at a leading edge thereof, as viewed in the sheet travel or transport direction, and conduct it from the last printing unit of a sheet-fed rotary printing press to the delivery pile 5. Directly before or upstream of the delivery pile 5, as viewed in the sheet travel or transport direction, the sheet 4 oncoming at high speed begins to be braked. Blast air directed opposite to the transport direction of the sheet 4 through the intermediary of an air-blast nozzle bar 6 extending across the sheet width or breadth and formed with a cross-sectionally rounded top side having air-blast nozzles provided therein is blown underneath the sheet released by the sheet grippers 1 of the gripper system 3. The quantity and pressure of the blast air are adjusted to a state of equilibrium with the kinetic energy emanating from the oncoming sheet, so that the sheet 4 is carried in a contact-free manner by the air flow in the region of the braking path.

Figure 2:
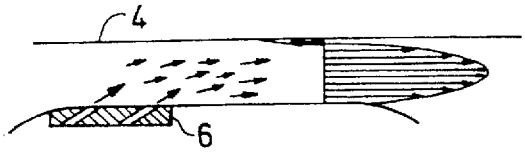
FIGS. 2 and 3 are enlarged fragmentary views of FIG. 1 diagrammatically representing therein the routing of air in the region of the braking section for the sheet to be braked.

FIG. 2 shows diagrammatically the formation of the shear-stress producing speed distribution in the air flow directed opposite to the sheet-transport or travel direction, the sheet being carried in a contactless or contact-free manner on a transport level spaced a distance above the sheet-guiding level determined by mechanical internal components. The shear stresses formed in the air stream counteract the kinetic energy of the sheet, so that the sheet is continuously braked. It is advisable not to brake the sheet to a standstill, but merely down to a residual speed which still permits satisfactory sheet deposition on the delivery pile.

Figure 3:
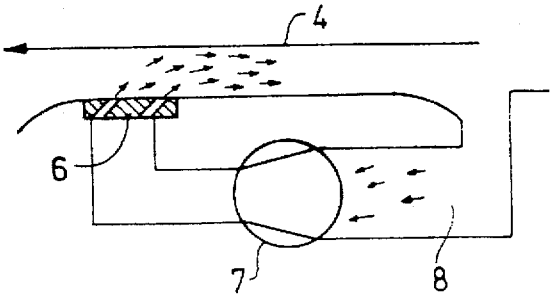

The diagrammatic view of FIG. 3 shows that the braking air blown underneath the sheet 4 for the purpose of braking the sheet is downwardly diverted at the beginning of the braking section and may, where appropriate, through the intermediary of a control element 7, be re-used as braking air to be blown underneath the sheet.

Figures 4A, 4B:
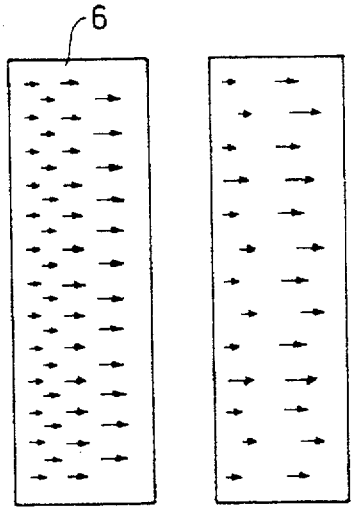
FIGS. 4*a* and 4*b* are diagrammatic top plan views of FIG. 3 showing two embodiments of the air routing.

The diagrammatic views of FIGS. 3, 4*a* and 4*b* show the formation of a braking section for the sheet in conjunction with the contact-free sheet-guiding arrangement due to the application of blast air which is blown beneath the sheet 4 in the sheet-transport direction. In such an arrangement, the two mutually opposed air flows, one of which is directed in the sheet-transport direction for conveying the sheet, and the other of which is directed opposite to the sheet-transport direction for braking the sheet, are downwardly diverted through the intermediary of a duct 8 and, where appropriate, through the intermediary of the control element 7, and are re-used as braking air to be blown underneath the sheet 4. FIGS. 4*a* and 4*b* show diagrammatically two alternative representative forms of the outflow directions of the air-blast nozzles in the air-blast nozzle bar 6.

FIGS. 5 and 6 illustrate an embodiment of the air-blast nozzle bar 6 according to the invention. The cross-sectional view of FIG. 5 shows an air-blast nozzle bar 6 formed of sheetmetal, with a pipe connection 10 for the blast air. The leading edge and the trailing edge of the air-blast nozzle bar 6, respectively, are rounded off in the transport direction of the sheet 4 represented by the arrow at the top of FIG. 5 and in the direction opposite thereto. The blast air escapes through air-blast nozzles 9 in the direction opposite to the transport direction of the sheet 4, the air-blast nozzles 9 being formed by tongue-shaped incisions 11 formed at the upper side of the air-blast nozzle bar 6, as shown in FIG. 6. Such incisions 11 are also to be found in the region of the rounded-off sections of the blast-air-nozzle bar 6, in order thereby to prevent the formation of negative pressure or vacuum underneath the sheet 4. At a sheet guide 12, the rear edge of the sheet 4 drops onto the main sheet pile 5 in the delivery.

FIG. 6 further shows that the blast-air device may have nozzles directed for discharging air in the sheet-transport direction.

Figure 7:
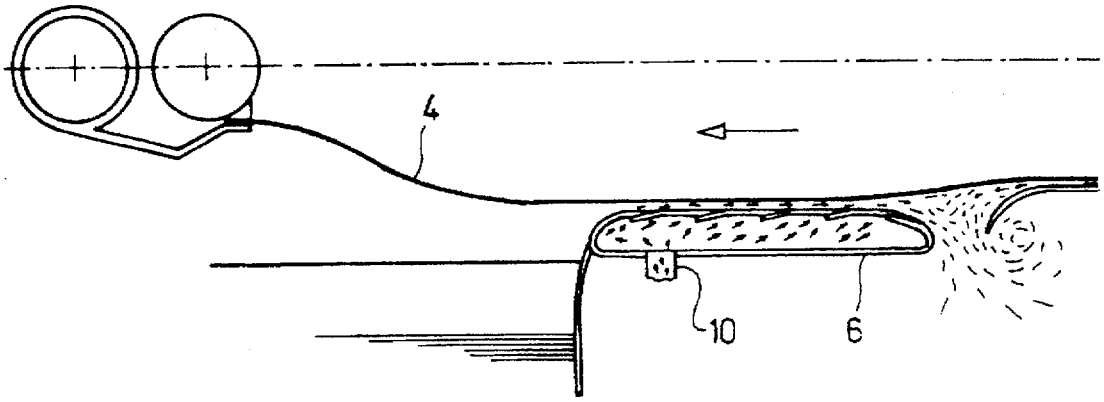
FIGS. 7 and 8 are views of FIG. 6 in reduced size and in a representation of the operating principle of the method according to the invention, FIG. 8 further showing the overlapping shingle-stream transport of sheets to the delivery pile with pneumatic sheet braking.

FIG. 7 illustrates the operating principle of the method for braking sheets by blast air in accordance with the invention. In the region of the braking section and against the transport direction of the sheet 4, blast air from the air-blast nozzles 9 of the air-blast nozzle bar 6 is blown beneath the sheet 4 which initially remains held at the leading edge thereof by the gripper system 3, thereby tautening and stretching the sheet 4. Shear stresses are accordingly formed beneath the sheet 4, as shown in FIG. 2, causing the sheet 4 to be braked after it has been released by the gripper system. The sheet 4 is then transported in a contact-free manner on the air flow for braking the sheet 4. In the arrangement shown in FIG. 7, the sheet 4 has already been transported over the braking section on an air flow directed in the transport direction of the sheet 4. The air flow carrying the sheet 4 and the opposing air flow for pneumatically braking the sheet are downwardly diverted directly before the braking section for the sheet 4. How the diverted air flow may possibly be returned or reversed has been explained hereinbefore with reference to FIG. 3.

Figure 8:
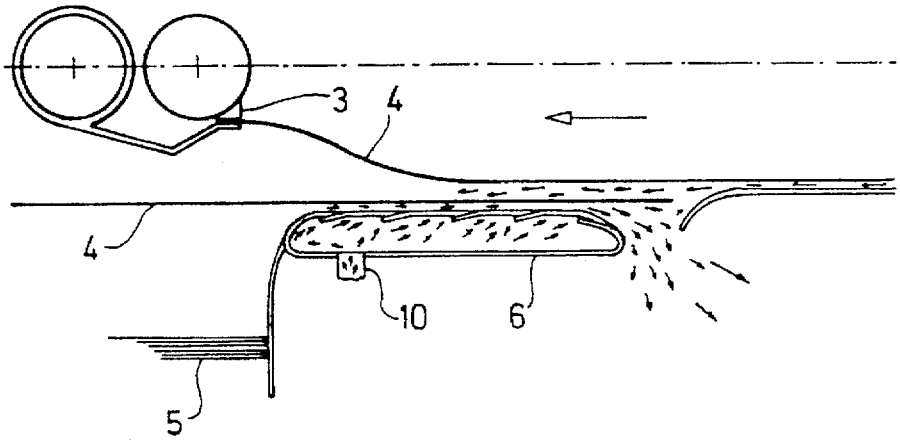

The diagram in FIG. 8 illustrates the overlapping shingle-stream transport of the sheets to the delivery pile 5. While the trailing end of a sheet 4, already released by the gripper system 3, remains exposed yet to the shear stresses of the braking air caused by surface friction, a succeeding sheet 4 remains held yet by the gripper system 3 and is carried by the air flow directed in the sheet-transport or travel direction represented by the large horizontal arrow in FIG. 8. Only when the trailing end of the preceding sheet 4 has cleared the duct 8 for diverting the sheet-transporting air and the sheet-braking air, is it possible for shear stresses to form also under the succeeding sheet 4 in order to brake the sheet. In this manner, a completely contact-free overlapping shingling of sheets occurs with the aid of the flotation-guiding arrangement disposed before, i.e., upstream, of the braking section, as viewed in the sheet-transport or travel direction, resulting also in time-saving for the braking of the sheet.

I claim:

1. Method for pneumatically braking sheets in a delivery of a sheet-fed rotary printing press by means of blast air directed opposite to a sheet-transport direction for forming an air flow for braking the sheet, which comprises:

providing a blast-air device located under the path of travel of the sheets;

transporting a sheet by a gripper system over the blast-air device;

adjusting air flow from an upper side of said blast-air device to create shear stresses arising between the sheet and the air flow for braking the sheet to a state of equilibrium between energy of the air flow acting upon the sheet and kinetic energy of the sheet, the sheet being carried in a braking path in a contact-free manner by the air flow.

2. Method according to claim 1, including downwardly diverting the air flow in a controlled manner upstream of said blast-air device, as viewed in the sheet-transport direction.

3. Method according to claim 2, wherein the blast air is emitted from braking nozzles, and which includes returning the downwardly diverted air flow to the braking nozzles through the intermediary of a control element.

4. Device for floatingly transporting and pneumatically braking sheets in a delivery of a sheet-fed rotary printing press by means of blast air directed opposite to a sheet-transport direction for floatingly transporting sheets in contact-free manner to a delivery pile, comprising:

a blast-air device for forming an air flow for braking the sheet, the air flow being directed against and beneath the sheet in a direction opposite to the direction of movement of the sheet, and a duct disposed in front of said blast-air device for diverting the air flow back to said blast-air device.

5. Device according to claim 4, wherein said blast-air device has blast-air nozzles and said blast-air nozzles are adjustable blast-air nozzles in a discharge direction.

6. Device according to claim 5, wherein some of said blast-air nozzles of said blast-air device are directed opposite to the sheet-transport direction and some of said blast-air nozzles are directed for discharging blast air in the sheet-transport direction.

* * * * *